US011724271B2

(12) United States Patent
Knight

(10) Patent No.: US 11,724,271 B2
(45) Date of Patent: Aug. 15, 2023

(54) ALL-POLYMER PUMP DISPENSER WITH ADAPTABLE INSERT AND INTERNAL PLUG SEAL

(71) Applicant: RIEKE PACKAGING SYSTEMS LIMITED, Leicestershire (GB)

(72) Inventor: Simon Christopher Knight, South Wales (GB)

(73) Assignee: RIEKE PACKAGING SYSTEMS LIMITED

( * ) Notice: Subject to any disclaimer, the term of this patent is extended or adjusted under 35 U.S.C. 154(b) by 15 days.

(21) Appl. No.: 17/628,918

(22) PCT Filed: Jul. 23, 2020

(86) PCT No.: PCT/EP2020/070878
§ 371 (c)(1),
(2) Date: Jan. 21, 2022

(87) PCT Pub. No.: WO2021/013966
PCT Pub. Date: Jan. 28, 2021

(65) Prior Publication Data

US 2022/0258192 A1 Aug. 18, 2022

Related U.S. Application Data

(60) Provisional application No. 62/877,394, filed on Jul. 23, 2019.

(51) Int. Cl.
*B05B 11/00* (2023.01)
*B05B 11/10* (2023.01)

(52) U.S. Cl.
CPC ..... *B05B 11/1042* (2023.01)

(58) Field of Classification Search
CPC ..... B05B 11/1042; B05B 11/0047; B05B 11/0033; B05B 11/0032; B05B 11/1032;
(Continued)

(56) References Cited

U.S. PATENT DOCUMENTS 4,867,347 A 9/1989 Wass
5,544,789 A 8/1996 Gillingham
(Continued)

FOREIGN PATENT DOCUMENTS

CA 2166655 7/1996
WO 2016063015 4/2016
WO 2017072506 5/2017

OTHER PUBLICATIONS

Patent Cooperation Treaty (PCT), International Search Report and Written Opinion for Application PCT/EP2020/070871 filed Jul. 23, 2020, dated Nov. 10, 2020, International Searching Authority, EP.
(Continued)

*Primary Examiner* — Vishal Pancholi
(74) *Attorney, Agent, or Firm* — McDonald Hopkins LLC

(57) ABSTRACT

A pump constructed entirely from a polymeric material is described. The pump includes an internal sealing plug and adaptable insert coupled to a resilient bellows structure. The plug includes a keyed feature that allows for selective sealing at the lower end of the pump chamber depending upon the rotational alignment of the actuator head and closure, owing to stopper mechanisms appropriately positioned along the peripheral interfacing surfaces of these components.

7 Claims, 8 Drawing Sheets

(58) Field of Classification Search
CPC ..... B05B 11/0044; B05B 11/0029; B05B 11/1069; B05B 11/1028; B05B 11/007
See application file for complete search history.

(56) References Cited

U.S. PATENT DOCUMENTS

| | | | | |
|---|---|---|---|---|
| 5,673,814 | A | 10/1997 | Terashima et al. | |
| 5,924,603 | A | 7/1999 | Santagiuliana | |
| 6,763,978 | B2 * | 7/2004 | Pritchett | B05B 11/1074 222/387 |
| 7,246,723 | B2 | 7/2007 | Santagiuliana | |
| 7,500,582 | B2 * | 3/2009 | Pritchett | B05B 11/0075 222/321.7 |
| 10,549,299 | B2 | 2/2020 | Knight | |
| 11,014,108 | B2 | 5/2021 | Knight | |
| 2017/0216864 | A1 * | 8/2017 | Knight | B05B 11/1059 |
| 2018/0318861 | A1 | 11/2018 | Knight | |

OTHER PUBLICATIONS

Patent Cooperation Treaty (PCT), International Search Report and Written Opinion for Application PCT/EP2020/070878 filed on Jul. 23, 2020, dated Oct. 21, 2020 International Searching Authority, EP.

* cited by examiner

ALL-POLYMER PUMP DISPENSER WITH ADAPTABLE INSERT AND INTERNAL PLUG SEAL

CROSS-REFERENCE TO RELATED APPLICATION

This application is a 35 U.S.C. § 371 national stage application of PCT Application No. PCT/EP2020/070878 filed Jul. 23, 2020, which claims priority to U.S. provisional patent application 62/877,394 filed on Jul. 23, 2019. The application relates generally to pump dispensers and, more specifically, to polymeric pump dispensers, made without metallic components, and including an internal plug seal cooperating with closure insert to enable their introduction and use in e-commerce shipping.

BACKGROUND

Containers for everyday household fluid products, such as soaps, cleaners, oils, consumable liquids, and the like, can be outfitted with dispensing pumps to improve a consumer's ability to access and use the fluid. Dispensing pumps of this type usually rely upon a reciprocating pump, driven by a compressible biasing member.

These products reach the end-use consumer via a bulk-shipment retail supply chain or by way of e-commerce (i.e., delivery to the consumer's home or business). Both supply chains require safeguards against damage and/or leakage of fluid caused by dropping the container(s), vibration, and the like. However, the e-commerce channel is particularly demanding since it is more cost effective to ship individual containers without any additional packaging. Also, because e-commerce shipping does not involve pallets or other means of confining the container to an upright position, the rotation, inversion, and jostling/vibration of the container and dispensing pump increases the likelihood that fluid can leak from the container. Despite these issues, the need for containers with dispensing pumps that can withstand the rigors of shipment also is expected to grow because of the growing popularity of on-line retailers who sell and ship individual fluid-containing products via e-commerce.

Another concern relates to sustainability. Increasingly, regulatory authorities are requiring consumer products manufacturers to use product packaging and designs that can easily be recycled. As a practical matter for businesses relying on pump dispensers, it is becoming increasingly important to design products made only from polymeric materials that can be recycled without the need to disassemble and/or separate out metal parts and components made from difficult to recycle materials (e.g., thermosetting resins, specialized elastomers, and other materials that either cannot be recovered or that require temperatures and conditions for recycling that are incompatible with the materials used in the other parts within the design).

United States Patent Publication 2018/0318861 discloses a dispenser pump with components that can be integrally formed from the same polymer. A deformable wall in the diaphragm body of this pump eliminates the need to rely upon a metallic biasing member. U.S. Pat. Nos. 7,246,723; 5,924,603; and 5,673,814 also disclose similar "all plastic" type designs for dispensing pumps, except with a "bellows-style" coiled cone instead of a diaphragm body.

In view of the foregoing, a pump dispenser made from polymeric materials that are easy to recycle would be welcome. Specifically, a pump design that did not require disassembly and separation of parts into separate recycling streams is needed.

Additionally, a pump design that enables e-commerce shipment without excess packaging or consumer-removed components is required. At present, external sealing plugs are inserted into the dispensing channel of some pumps to avoid leakage during shipment. Not only are these external plugs an added cost, they can be considered unsightly and difficult to remove by consumers. Further, their positioning on the exterior of the pump gives rise to the possibility that they may become dislodged during shipment. More generally, consumers are not likely to reinstall the plug after the pump is first used, so current pumps lose a measure of their sealing security when the external plugs are discarded.

Further still, a pump design that included a simple rotational lock to avoid unwanted actuation would be welcomed. There is also a need for a rotational lock that can cooperate with the aforementioned seal plug to allow for seamless, first time activation and use.

SUMMARY OF INVENTION

Operation of the invention may be better understood by reference to the detailed description, drawings, claims, and abstract—all of which form part of this written disclosure. While specific aspects and embodiments are contemplated, it will be understood that persons of skill in this field will be able to adapt and/or substitute certain teachings without departing from the underlying invention. Consequently, this disclosure should not be read as unduly limiting the invention(s).

A reciprocating pump dispenser can be made entirely from recyclable materials, such as polymers, without the need for metal components. The proposed pump includes an insert fitted to and sealing a closure body that, itself, connects to a container. A resilient bellows is coupled to the insert, forming a pump chamber therebetween. A free-floating plug seal rests in a lower well of the insert, so as to seal the bottom portion, while a flap valve seals the top portion of the chamber proximate to where the bellows connects to an actuator head. When the actuator head is initially rotated between stopper positions (with the stoppers formed on the closure body), a sinuous formation such as a groove or ridge formed on the lower reaches of the closure insert changes the elevation of the insert relative to the closure and, in so doing, causes the plug seal to become dislodged from the closure body to allow for actuation and use of the pump.

The resulting design requires components of lesser mass in comparison to other proposals while delivering sufficient sealing characteristics for e-commerce shipping. Further, by using an adaptable insert fitted between a standard-sized closure and the resilient bellows, this design may be incorporated into existing closure/container combinations without the need for specialized components.

DESCRIPTION OF THE DRAWINGS

The appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure:

FIG. 3A is a three dimensional perspective view of the top facing of the bellows, while

DETAILED DESCRIPTION

Figure 1:
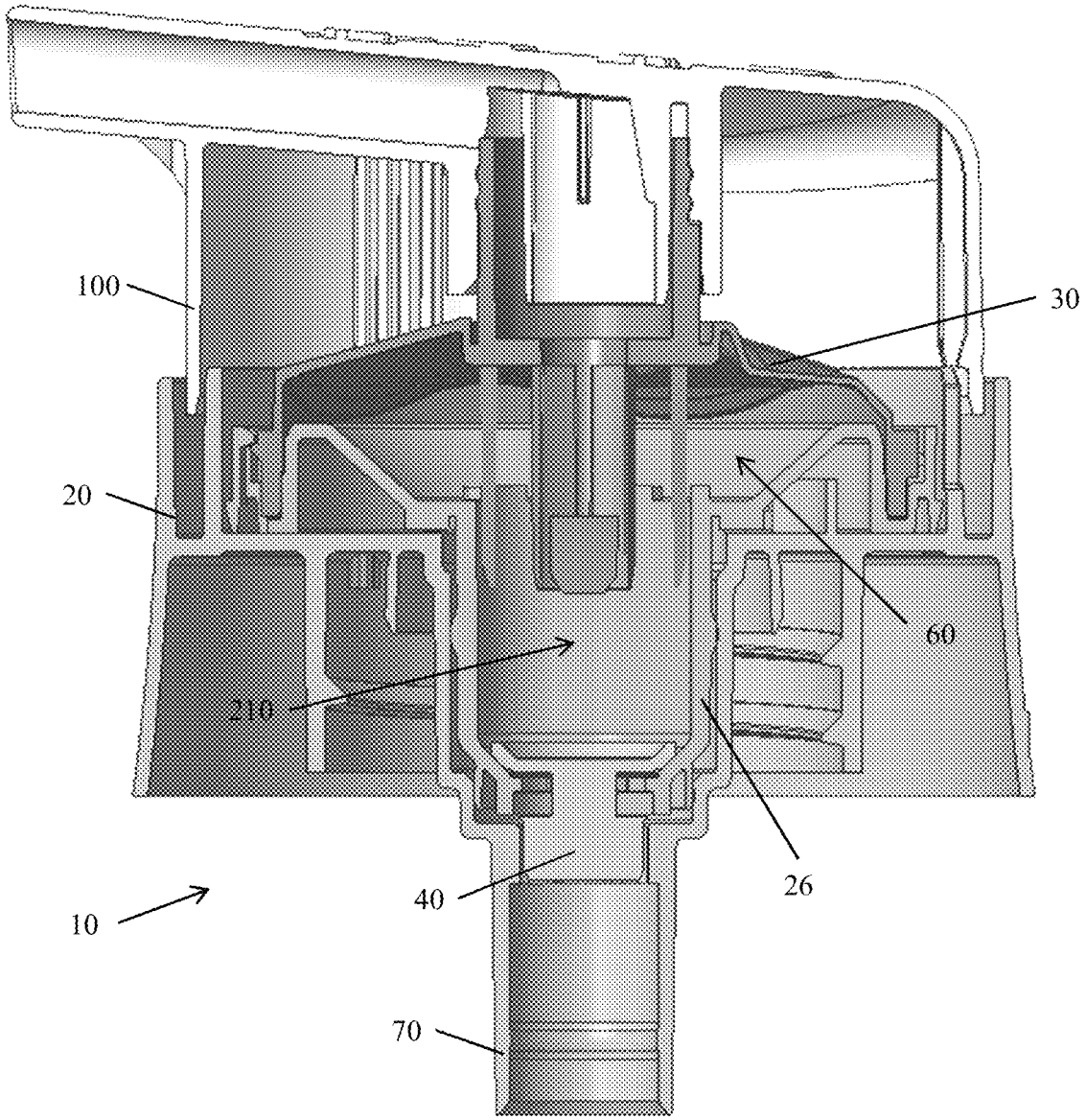
FIG. 1 is a cross sectional plan view
Figure 2A:
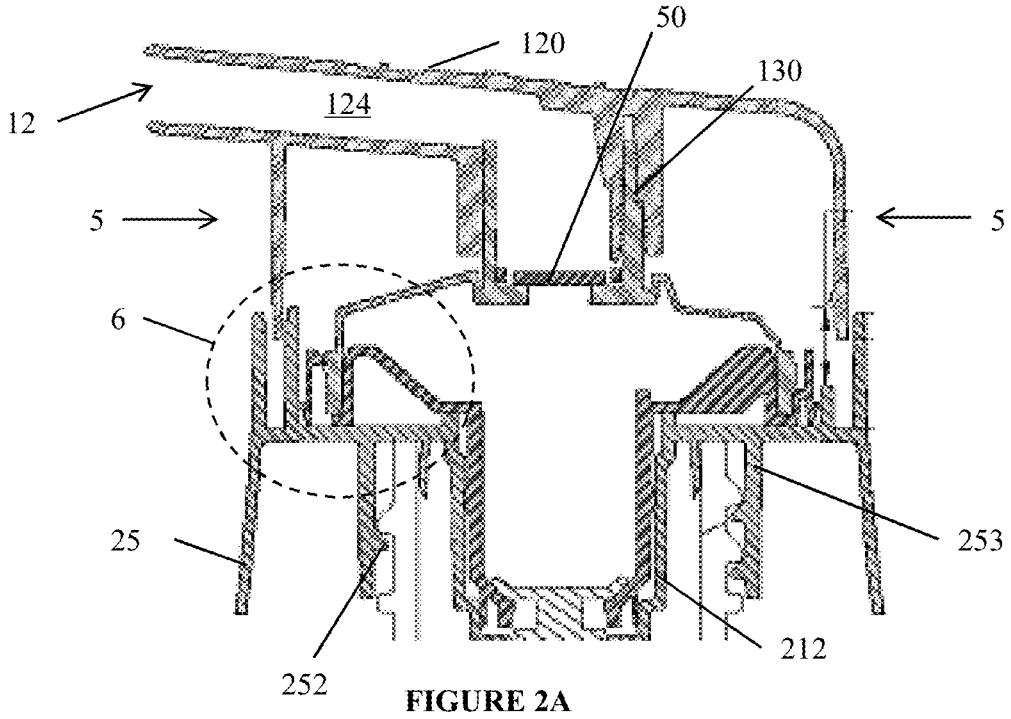
FIG. 2A is a sectional side view of the top portions of the dispenser pump according to certain disclosed aspects, including details on the actuator head, bellows, closure insert, closure body and plug seal.
Figure 2B:
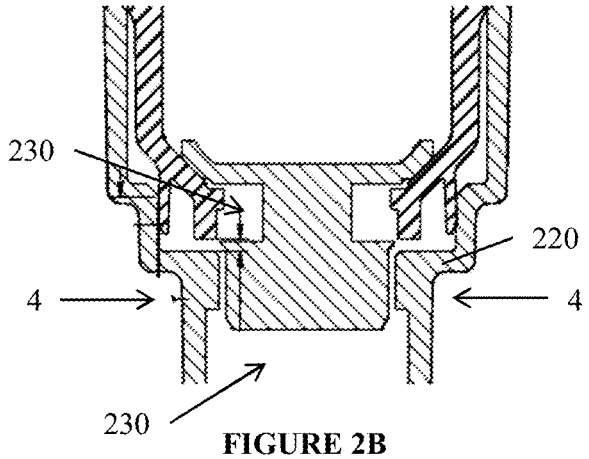
FIG. 2B is a sectional side plan view of the lower portions of the dispenser pump of FIG. 1, further highlighting the interfaces between the closure insert, the closure body, and the plug seal proximate to the inlet to the pump chamber.
Figure 3A:
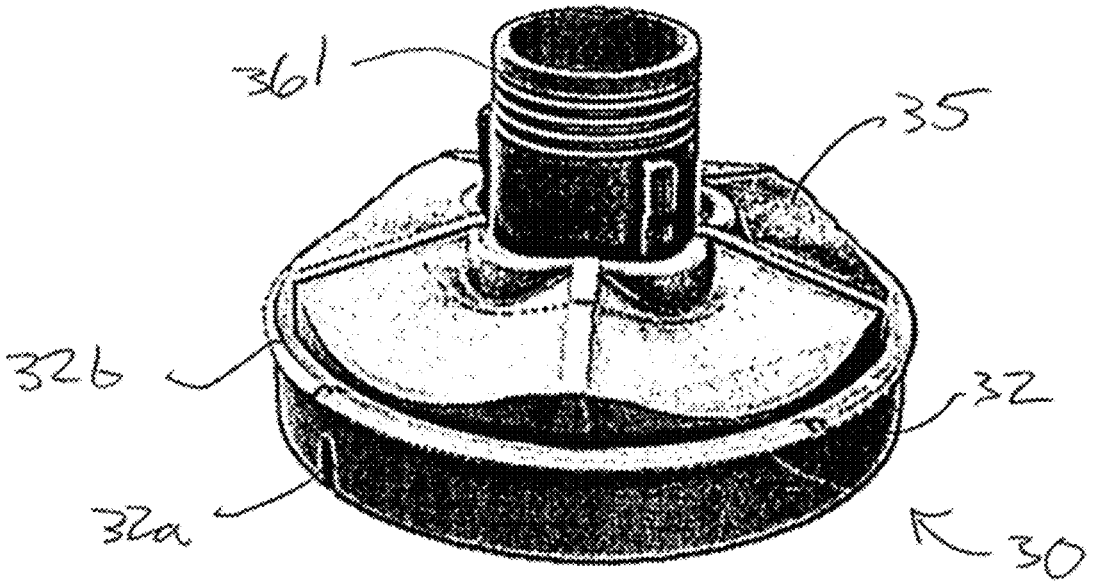
Figure 3B:
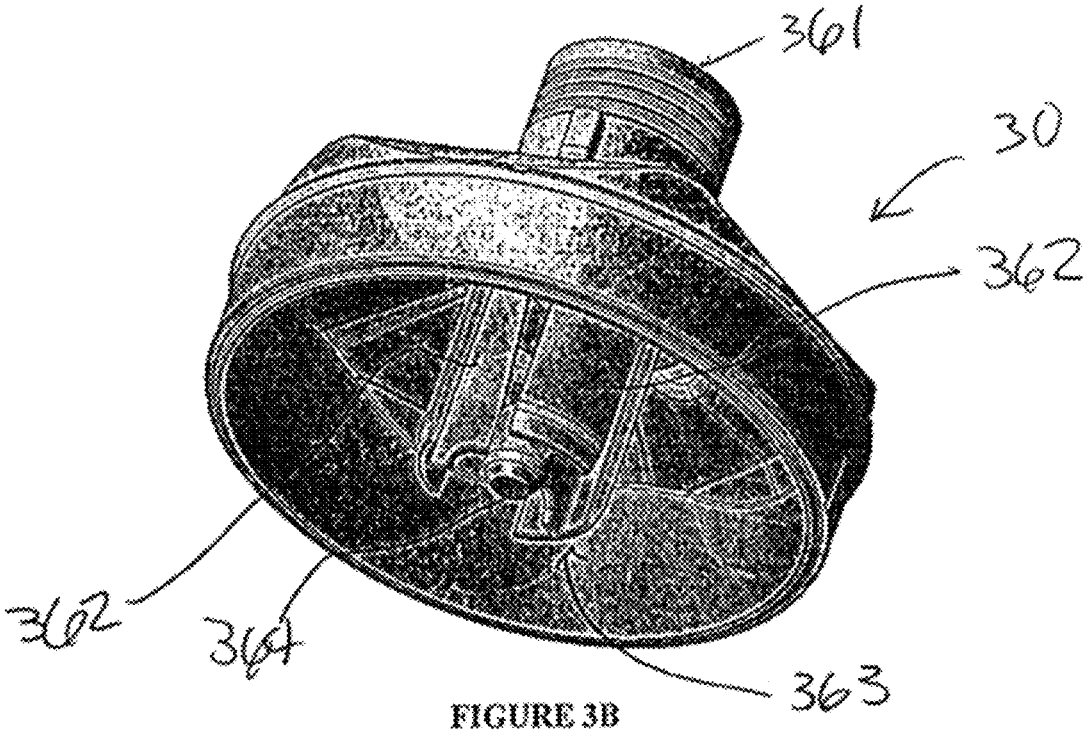
FIG. 3B is a similar view showing its bottom facing.
Figure 3C:
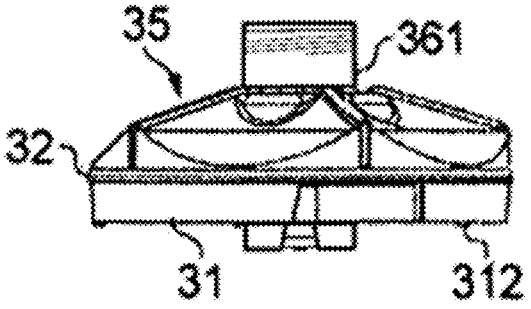
FIG. 3C is a side plan view and FIG. 3D is top plan view, both of the bellows shown in FIG. 3A.
Figure 3D:
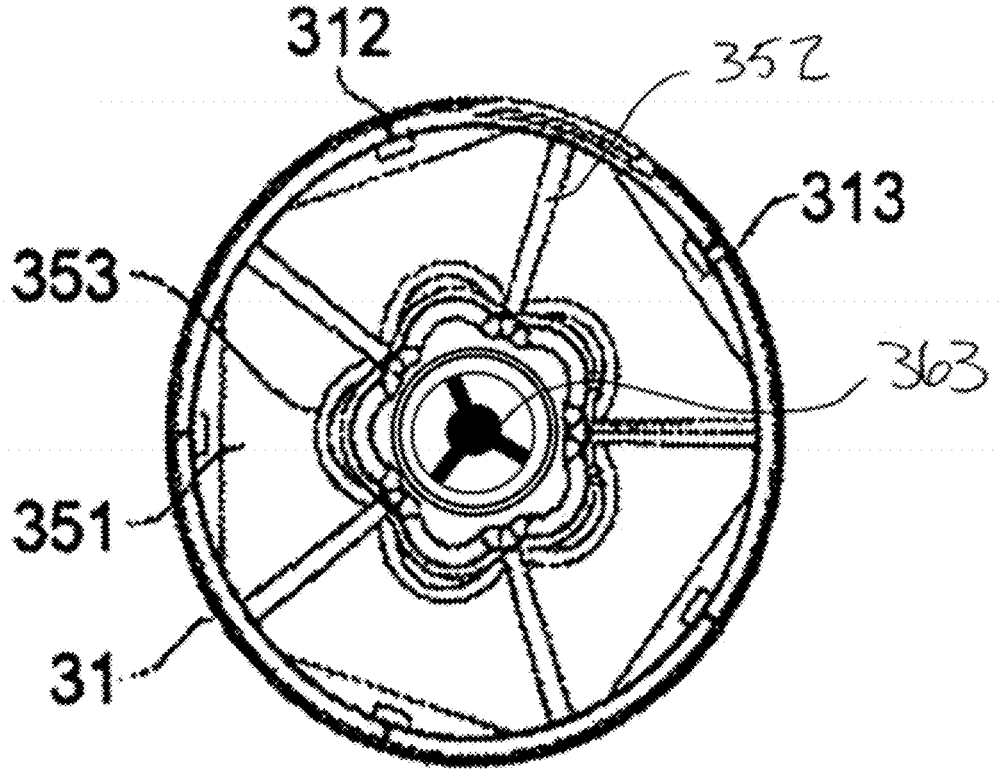
Figure 4A:
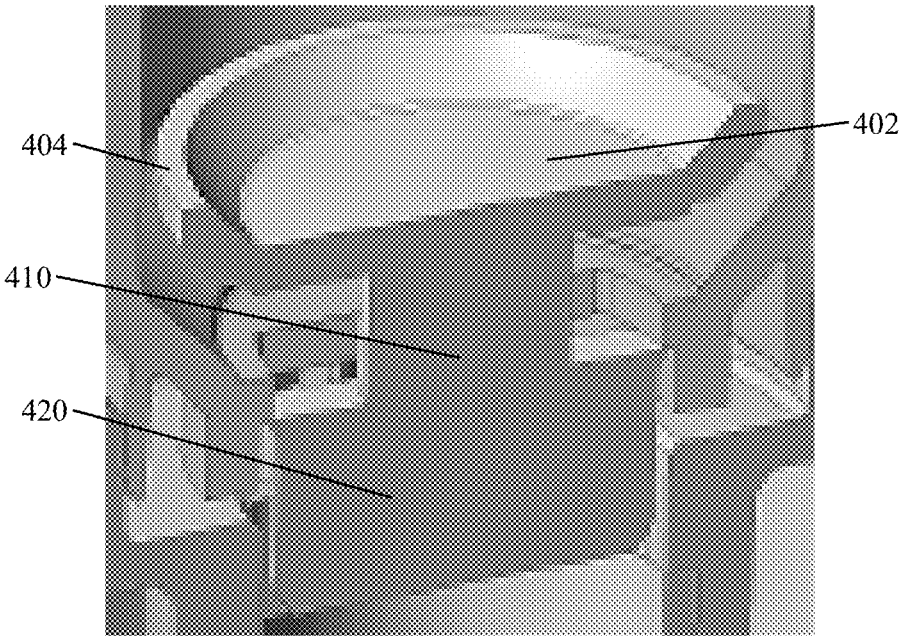
FIG. 4A is a three dimensional cross sectional illustration of the plug seal, including a keyed projection or poppet along its lower extremities fitting through the closure insure and closure body.
Figure 4B:
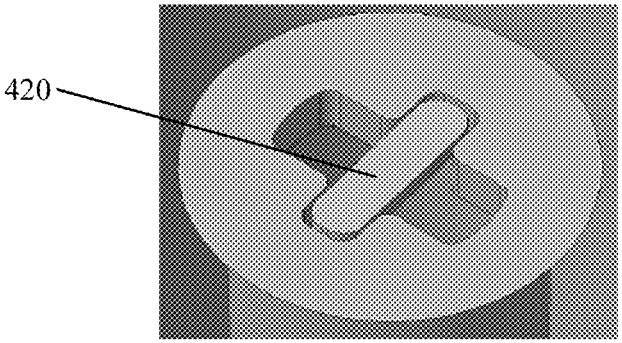
FIG. 4B is a sectional view taken along line 4-4 in FIG. 2B highlighting the keyed fit of the plug into the closure body according to certain aspects.

Specific reference is made to the appended claims, drawings, and description, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

With reference to the drawings, a dispenser pump is attachable to a container neck. The pump itself includes four main parts, all of which may desirably be constructed from the same (or functionally equivalent) polymeric materials or polymer material types so as to simplify recycling. The four parts include an actuator head, a bellows, a closure body, and an internally held plug seal. Further components include a dip tube and a pair of flap valves held at opposite ends of the pumping chamber defined by the plug seal and the bellows.

Aspects of the invention are set out in the claims. One aspect of the invention relates to a free-floating plug that fits within a recessed cylinder forming the lowermost end of the pumping chamber. The pumping chamber, of course, is defined as the space between the deformable and resilient bellows and the upper facing surfaces of an insert attached to the closure piece. The insert includes a collar wave that allows the insert to change its axial elevation, relative to the closure body itself, when the assembly is rotated (with such rotation enabled and urged on by twisting the actuator relative to the container, which can be facilitated by anti-back off ribs, cooperating projections on the various components, and the like). As the closure insert is lifted upward, the plug is urged out of its sealing position and allowed to float freely within the inlet, thereby acting as an inlet valve. Further, because rotation of the actuator and closure insert is restricted to a predefined range, this rotation serves to toggle the plug between a sealed position that is appropriate for e-commerce and a floating position whereby the pump can operate because the plug merely serves as a normal inlet valve.

Other aspects relate to the provision of an attachment groove in the collar insert. This groove receives the lower edge of the bellow and permits rotation of the bellows therein. Thus, because the bellows also attaches to the actuator head at is upper end, the actuator and bellows slide freely within the insert, while the closure body itself remains anchored, possibly by the aforementioned projections, in place on the container. Further, the actuator may include a C-shaped stopper formed on its extension channel piece that connects to the top portion of the bellows, thereby circumscribing a range of rotation through which the actuator head may be turned.

Turning to the plug seal, it includes a central sealing disc with a downward keying projection that fits through inlet apertures formed in both the insert and the closure body. Thus, the plug seal is capable of remaining seated in a sealing position, with the anti-rotation The recess at the bottom of the pumping chamber is shaped to receive the plug. The top portion of the plug forms a circular seal around the inlet aperture of the chamber. This circular seal includes an extended, narrowed neck portion that attaches to a lower key-section of the plug. The key section includes radially extending flanges sized to engage the bottom of facing periphery of the inlet aperture. In this manner, when the plug is rotated, it may either catch on the periphery to keep the plug in place (thereby sealing off the pump chamber from the inlet) or the key section may move axially up and down through the inlet aperture (as would be required during pumping operations). Additional flanges or structure may be provided to ensure that the plug does not become completely displaced; for example, at the lower extremities of the plug, an outermost bead may extend radially beyond the key-flanges diameter to ensure that the plug does not move completely out of the inlet aperture. Ramps or cams may also be employed to facilitate the relative positioning of the plug within the inlet/insert, to ensure reliable sealing performance.

The plug may rotate along with the actuator head. That is, stopper structures may be provided on interfaces between the adjoining parts (e.g., actuator head and closure, closure and insert, etc.) to ensure these pieces move in concert. By positioning the stoppers appropriately, the plug can be easily moved from a sealed or blocking position, where the key flanges inhibit axial movement of the plug within the aperture, to an operable position where the key flanges move freely up and down within the aperture.

Now, turning to FIGS. 1 through 7B, pump 10 includes actuator 100, closure body 20, closure insert 26, bellows 30, plug seal 40, outlet valve 50 and dip tube 70. Variable volume pump chamber 60 is defined by the inner top facing of the bellows 30 and closure insert 26, with an inlet connecting to the dip tube on the bottom end and an outlet connecting to the dispensing channel of the actuator on the top end.

Actuator head 100 has a cup-like shape, with a sidewall 102 received within a channel or groove 262 formed on a periphery of the insert 26. Inward projections 110 can be formed on an inner circumference of the head 100 to serve as rotational stoppers. A nozzle 120 encompasses the pump assembly outlet 122. A dispensing channel 124 connects outlet 122 to the interface connector 130 where the head 100 connects to the bellows 30. Interface 130 may include an annular flange or groove 132 extending partially or completely around connector piece 130 so as to receive a portion of the outlet tube 361 on the bellows 30 and the downwardly disposed connection cylinder 134 of the connection piece. Notably the dispensing channel 124 may be inclined so that the outlet 122 is elevated in order to avoid unwanted dripping.

Figure 5:
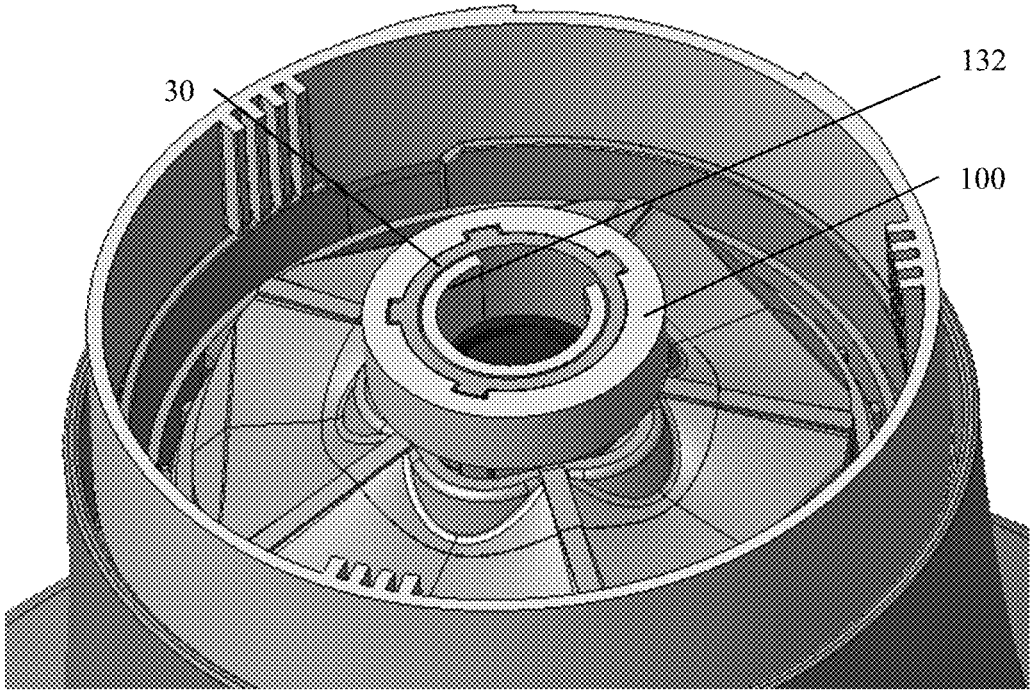
FIG. 5 is a three dimensional sectional view taken along line 5-5 in FIG. 2A highlighting the interface between the actuator and the bellows.
Figure 6A:
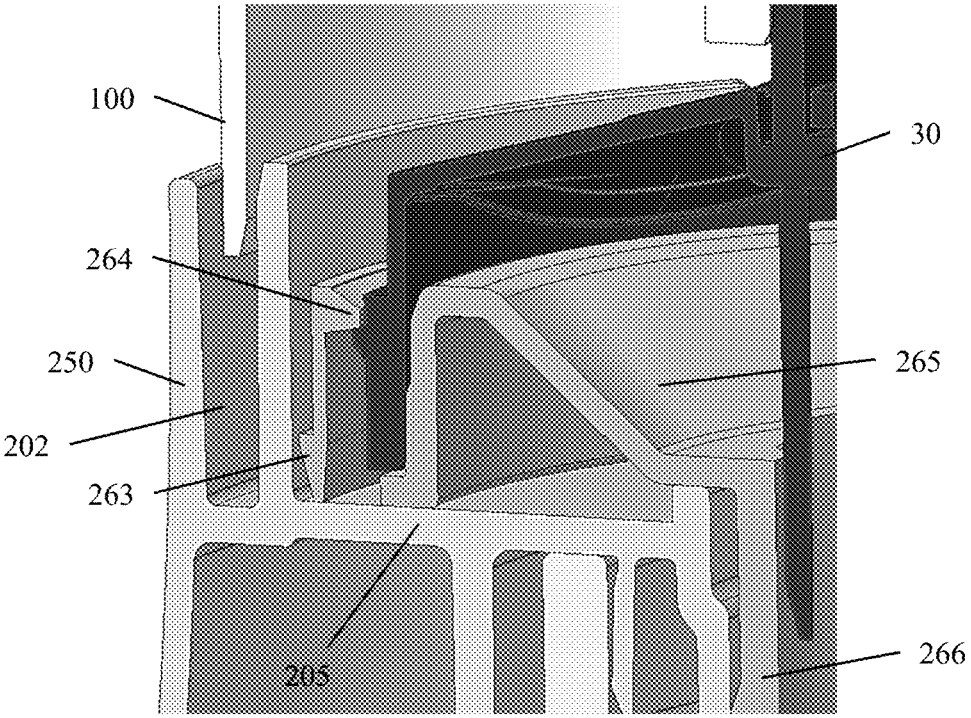
FIG. 6A is an exploded three dimensional cross sectional view of callout 6 in FIG. 2A highlighting the interface between the closure body, the closure insert and the bellows, with particular emphasis on the fit and arrangement of these components at their peripheral seal.
Figure 6B:
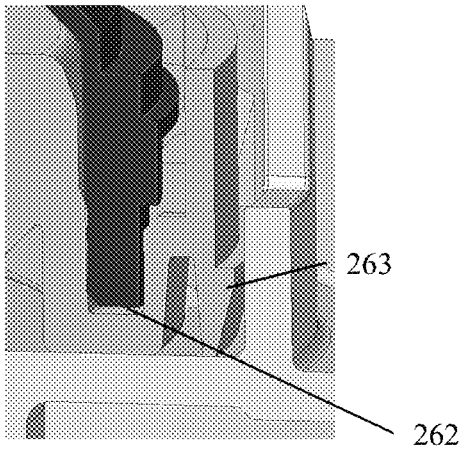
FIG. 6B shows an alternative structural arrangement for capturing the bellows within the closure insert periphery.
Figure 7A:
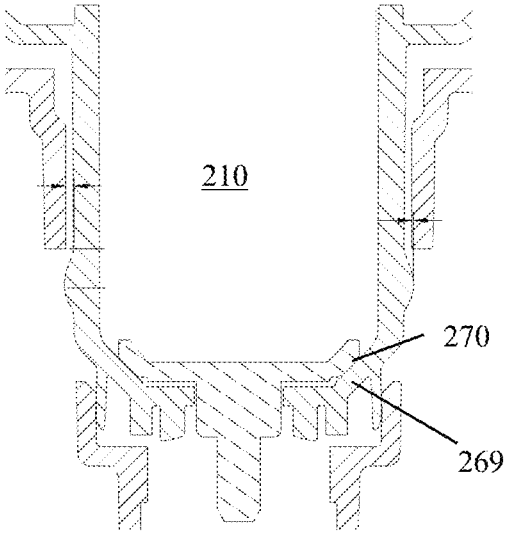
FIG. 7A is a schematic cross sectional plan view illustration of the interface between the closure insert, the closure body, and the plug seal particularly where the collar wave cooperates with the closure body.
Figure 7B:
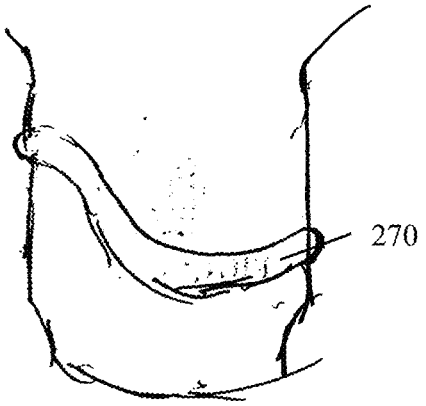
FIG. 7B is an isolated, three dimensional view of the collar wave.

As best seen in FIG. 5, the connector piece may be formed as a partial cylinder, effectively having a C-shape when viewed in horizontal cross section. The edges of this C-shape serve as stoppers to limit the rotation of the actuator 100 relative to the closure body 20. Further, the presence of insert 26 and the connection of bellows 30 to insert 26 further facilitates the relative rotation and movement of the actuator 100 vs. the closure body 20, which enables the insert 26 to move with the actuator 100 and, by virtue of sinuous collar wave formations 270, urge the plug seal 40 into or out of sealing position.

Closure body 20 also has a generally cylindrical shape with an H-shaped cross-section as best seen in FIG. 1. Outer sidewalls 250 extend in a substantially vertical direction, although a slight taper may be imparted. Horizontal floor 205 connects along a midpoint of the sidewalls 250, although the floor 205 need not be perfectly flat, so as to accommodate features such as groove 202, recess 210, inlet 230, and the like.

Groove 202 receives an edge of the actuator 100, thereby allowing for the axial movement of the actuator. Floor 205 and recess 210 are sized to receive and retain insert 26.

A recess 210 is inset along a central portion of floor 205. Recess 210 includes a cylindrical sidewall 212 extending downwardly below the floor/facing 200. Bottom ledge 220 defines and surrounds an inlet aperture 230. Plug 40 is received through the aperture, and ledge 220 has sufficient horizontal surface to accommodate portions of the insert 26 as described below.

Cylindrical sidewalls 250 extend below the facing 200, so as to coaxially enclose the sidewalls 212 of the recess 210, and the bottom edge of sidewalls 250 may coincide with, terminate at a comparatively higher elevation, or extend beneath the plane defined by ledge 220. Coupling formations (e.g., threads) 252 are provided on the inner facing of sidewalls 250 and/or on a vertical sealing extension 253 protruding downward from floor 205, with formations 252 allowing for attachment to a container or other fluid carrying implement.

While not shown, the container neck may include one or more protrusions or ribs that cooperate with similar formations on the closure body 20 proximate to/formed integrally as part of formations 252 so as to limit and/or prevent unwanted rotation of the pump.

Insert 26 serves as an overlay interposed between the top facing of the closure body 20 and the bellows 30. Insert 26 includes an attachment groove 262 along its peripheral edge, with an outer facing barb or protrusion 263 to help retain insert 26 within the sidewalls 250 immediately above the floor 205 of the closure body 20. Additional barbs 264 face inward to help retain and control the movement of the bellows within groove 262.

Insert include an angled, bowl-like section 265 which funnels downward so the that lower, central portion of insert 26 conforms closely to the recess 210. In particular, tubular extension 266 fits closely within the sidewalls 212. A sinuous ridge or projection 270 is circumscribed around an outer-facing of the extension 266, with a cooperating formation in the sidewalls 212 (e.g., an aperture and/or bead) urging the insert 26 upward or downward in response to rotatory force exerted on the insert 26 by virtue of its connection to the bellows 30 (which, in turn, are attached to and move in response to rotary force exerted on the actuator 100). In this manner, leg extensions 268 may engage or lift away from the ledge 220. A funnel shaped terminal edge 269 defines an inlet aperture 230 formed through the insert 26 (note that aperture 230 also carries through the body 20 and, more specifically, through the ledge 220). The edge 269 is shaped to cooperate with the top portions of the plug 40 so as to dislodge it from a sealing position in response to the axial movement imparted by rotation of the ridge 270 relative to the body 20.

Bellows 30 includes a deformable top wall 35 and downwardly extending skirt 32. Skirt 32 may include coupling features 32*a*, 32*b* to facilitate its connection to the closure body 20. An outlet tube 361 extends above the plane formed by top wall 35, while tube-like projections 362 extend downward beyond the skirt 32.

Bellows 30 also includes an outer annular support portion 31, a central rigid hub or actuator connector 361 and a deformable wall 35 extending between them. Preferably, bellows 30 can be a single molding of polypropylene. The annular support structure 31 couples to or is formed integrally with the skirt 32.

In some embodiments, the support 31 may be thicker than the deformable wall 35 to provide firm mounting and support, and is sized to fit within and, preferably, couple to the groove 207. Thus, when the actuator 100 is depressed in a dispensing stroke, hub 361 descends substantially beneath the periphery of the deformable wall 35, pulling in the top of the support ring 31. This disengages or relaxes a seal between the top parts of these components, allowing venting air to enter. Notably, connector 361 includes a seat on its inner facings to accommodate and hold outlet valve 50.

The support ring 31 may also include downwardly-projecting nibs 312 and inwardly-projecting nibs 313. The nibs 312 locate it with slight clearance from top facing 203 to assure venting and also to reduce friction, so that the bellows 30 can be rotated relative to the closure body 20, at least within a predefined arc that coincides with movements permitted by stoppers 204 and/or other structures proximate to or connected with the bellows 30 (e.g., closure body 20, actuator 100, etc.).

The deformable wall 35 has a plurality of gently-inclined segments or facets 351 forming a generally pyramidal shape around the tube 361. For each facet 351 the hub has a projecting cylindrical portion 353 which is downwardly angled, maintains its rigidity, and meets the facet 351 along a curved boundary so that, when the hub 36 is pushed down, the cylindrical formations 353 force heavy bending of the facet 351 along that boundary, creating a restoring force much greater than would arise from a general bending of the facets sufficient to accommodate the same distance of deformation. Thicker radial ridges 352 extend between the facets 351. While five facets 351 are illustrated, it is possible to apply this design feature to any whole integer between 3 and 9 without departing from the general principle of operation.

Tube-like projections 362 extend axially downward from the bellows 30 and, more specifically, the wall 35. These projections 362 can be formed as elongated flanges arranged in a circular fashion to mimic the shape of outlet tube 361, thus giving each projection 362 a T-like shape in which a partial arced wall connects to a radially oriented wall which, in turn, connects to a central nub so as to form a web 363. At a terminal (i.e., lowermost) end of projections 362, a web 363 is formed. Notably, projections 362 and web 363 do not fully enclose and seal the structure and, instead, openings are deliberately provided so as to allow fluid to flow freely therethrough. In some embodiments, it is not necessary to provide either the projections 362 or the web 363. Conversely, projections 362 and/or web 363 could be sized and positioned appropriately to urge the plug seal 40 into a more secure, interference fit when the actuator is fully depressed.

Plug 40 has a circular sealing disc 402 disposed near its upper reaches. Disc 402 may be surrounded by a winged flange 404 that cooperates with the shape of funnel edge 269 to seal the aperture 230. Further, when the plug 40 floats freely, it lifts away from the edge 269 to function as a conventional inlet valve, as might be found in any number of other pump designs.

Connector element 410 extends downward from the disc 402 and attaches to one or more keying projections 420. The keying projection fits in/through the ledge 220 so as to selectively block the aperture 230 in the body closure 20.

Additional features can be discerned from the attached drawings. Key items include the shape of the bellows, the provision of a plurality of axial flanges from the top of the bellows into the pumping chamber, and structures to couple the adaptable insert to the bellows (on one facing) and to the closure (on another facing). The insert may include a bowl-shaped indent at its upper ends, where it interfaces with the bellows so as to allow for adaptation of the pump chamber volume and, by extension, the pumping characteristics.

As noted above, the initial priming action couples the plug to the bellows and displaces the seal when the bellow returns to its upward position. With each downward stroke, the volume of the pump chamber formed between the bellows and the closure body is temporarily reduced, thereby creating suction to draw fluid up into the pump chamber. Once primed, fluid that was previously drawn into the chamber will be dispensed through the outlet flap valve into the dispensing channel and out of the nozzle when the head is depressed. Make up air is admitted back into the container as the bellows expands through separate venting apertures in the head, bellows, and/or closure body, although these apertures only align when these components are rotated into the dispensing position (i.e., so that the axial stops do not restrain movement of the head). One example of a resilient bellows (and other features and aspects) appropriate for use in some aspects of this invention can be found in United States Patent Publication 2018/0318861, which is incorporated by reference.

The remaining features of the pump relate to its basic function. For example, a dip tube ensures fluid can be drawn up from the internal volume of the container. The container is configured to couple to the pump body, usually by way of a threaded connection, so that the pump engages a corresponding set of features at or proximate to the container mouth. The container itself must retain the fluid(s) to be dispensed and possess sufficient rigidity and/or venting capability to withstand the pumping motions and attendant pressure differentials created by the structures disclosed herein.

All components should be made of materials having sufficient flexibility and structural integrity, as well as a chemically inert nature. Certain grades of polypropylene and polyethylene are particularly advantageous, especially in view of the absence of any thermosetting resins and/or different, elastomeric polymer blends. The materials should also be selected for workability, cost, and weight. Common polymers amenable to injection molding, extrusion, or other common forming processes should have particular utility.

Notably, the dimensions of the components ensure that the initial sealing and seating of the internal plug against the inlet port will be sufficiently strong and secure to enable the pump assembly to shipped in e-commerce channels. Further, when coupled with rotational stops and/or other known up-lock mechanisms, further safeguards against unwanted leakage and actuation can be realized.

The aspects disclosed herein also eliminate the need for any external plug or other sealing devices that must be manually removed by the user. Instead, the internal plug remains within the assembly and, owing to its composition matching that of the other components, the entire assembly can be recycled as a monolithic unit (i.e., without disassembly or separation of those components). In this manner, waste is reduced and the user experience is simplified and improved.

Various aspects of the invention are disclosed in the claims, but it will be understood that any or any combination of the features is expressly contemplated. Therefore, the invention may include any or any combination of the following:

- an actuator head defining a dispensing channel and having axially extending sidewalls with at least one rotational stopper formed thereon;
- a closure body may have a floor extending between cylindrical sidewalls, said floor having a central recessed portion defined by tubular walls terminating in a ledge defining an inlet aperture;
- an insert may be overlaid atop a closure body between the cylindrical sidewalls thereof, said insert including a central cylindrical member, fitted within and substantially conforming to the recess, having an inlet aperture at a bottom-most edge and a sinuous ridge formed on an outer face thereof;
- a deformable, resilient bellows can be coupled to a peripheral groove formed in the insert so as to define a pump chamber, said deformable bellows including an upward connection tube forming an outlet from the pump chamber, said bellows coupled to the actuator head so as to allow axial actuation movement that temporarily alters a volume of the pump chamber;
- a sealing plug may be carried partially within the cylindrical member and sized to seal the inlet aperture of the insert, said sealing plug may include a keying projection sized to seal the inlet aperture of the closure body;

in response to rotary movement, the sinuous ridge may cooperate with the closure body to displace or seal the sealing plug relative to the inlet aperture of the insert;

the actuator head, the closure body, the bellows, and the sealing plug are desirably all made from recyclable thermoplastics, e.g. from the same polymer type such as polyolefin (polyethylene, propylene), or the like;

the actuator head, the closure body, the deformable bellows, and the sealing plug may be made from a single thermoplastic material e.g. polypropylene;

there may be a plurality of rotational stopper formations cooperating with formations on the closure body;

the insert may include a raised funnel-shaped wing disposed between the peripheral groove and the cylindrical member;

a said cylindrical member may include downwardly extending legs which engage the ledge;

a said peripheral groove may include formations to retain the insert within the cylindrical sidewalls of the closure body along a top facing thereof.

References to coupling in this disclosure are to be understood as encompassing any of the conventional means used in this field. This may take the form of snap- or force fitting of components, although threaded connections, bead-and-groove, and slot-and-flange assemblies could be employed. Adhesive and fasteners could also be used, although such components must be judiciously selected so as to retain the recyclable nature of the assembly.

In the same manner, engagement may involve coupling or an abutting relationship. These terms, as well as any implicit or explicit reference to coupling, will should be considered in the context in which it is used, and any perceived ambiguity can potentially be resolved by referring to the drawings.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A dispenser pump comprising:

an actuator head defining a dispensing channel and having axially extending sidewalls with at least one rotational stopper formed thereon;

a closure body having a floor extending between cylindrical sidewalls, said floor having a central recessed portion defined by tubular walls terminating in a ledge defining an inlet aperture;

an insert overlaid atop the closure body between the cylindrical sidewalls thereof, said insert including a central cylindrical member, fitted within and substantially conforming to the recess, having an inlet aperture at a bottom-most edge and a sinuous ridge formed on an outer facing thereof;

a deformable, resilient bellows coupled to a peripheral groove formed in the insert so as to define a pump chamber, said deformable bellows including an upward connection tube forming an outlet from the pump chamber with an outlet valve held therein, said bellows being coupled to the actuator head so as to allow an axial actuation movement that temporarily alters a volume of the pump chamber;

a sealing plug carried partially within the cylindrical member and sized to seal the inlet aperture of the insert, said sealing plug including a keying projection sized to seal the inlet aperture of the closure body;

wherein, in response to rotary movement, the sinuous ridge cooperates with the closure body to displace or seal the sealing plug relative to the inlet aperture of the insert; and wherein the actuator head, the closure body, the bellows, and the sealing plug are made from recyclable thermoplastics.

2. The dispenser pump of claim 1 wherein the actuator head, the closure body, the deformable bellows, and the sealing plug are made from a single thermoplastic material.

3. The dispenser pump of claim 1 wherein there are a plurality of rotational stopper formations cooperating with formations on the closure body.

4. The dispenser pump of claim 1 wherein the insert includes a raised funnel-shaped wing disposed between the peripheral groove and the cylindrical member.

5. The dispenser pump of claim 1 wherein the cylindrical member includes downward extending legs which engage the ledge.

6. The dispenser pump of claim 1 wherein the peripheral groove includes formations to retain the insert within the cylindrical sidewalls of the closure body, along a top facing thereof.

7. The dispenser pump of claim 1 wherein the sealing plug includes an upper disc with a connection member extending downward therefrom and terminating in the keying projection.

* * * * *